US005234889A

United States Patent [19]

DePalma et al.

[11] Patent Number: 5,234,889

[45] Date of Patent: Aug. 10, 1993

[54] SLIPPING LAYER FOR DYE-DONOR ELEMENT USED IN THERMAL DYE TRANSFER

[75] Inventors: Vito A. DePalma; Catherine A. Falkner, both of Rochester; Ravi Sharma, Fairport; Paul D. Yacobucci; David P. Brust, both of Rochester, all of N.Y.

[73] Assignee: Eastman Kodak Company, Rochester, N.Y.

[21] Appl. No.: 992,234

[22] Filed: Dec. 17, 1992

[51] Int. Cl.[5] ..... B41M 5/035; B41M 5/38

[52] U.S. Cl. ..... 503/227; 428/195; 428/447; 428/913; 428/914

[58] Field of Search ..... 503/227; 428/195, 447, 428/913, 914

[56] References Cited

U.S. PATENT DOCUMENTS

| | | | |
|---|---|---|---|
| 4,910,087 | 3/1990 | Torii et al. | 428/423 |
| 4,942,212 | 7/1990 | Hanada et al. | 528/28 |
| 4,961,997 | 10/1990 | Asano et al. | 428/423.1 |

FOREIGN PATENT DOCUMENTS

| | | | |
|---|---|---|---|
| 2-228323 | 9/1990 | Japan | 503/227 |

*Primary Examiner*—Pamela R. Schwartz
*Attorney, Agent, or Firm*—Harold E. Cole

[57] ABSTRACT

A dye-donor element for thermal dye transfer comprising a support having on one side thereof a dye layer and on the other side a slipping layer comprising a lubricating material and wherein the lubricating material consists essentially of a poly(aryl ester, aryl amide)-siloxane copolymer, the polysiloxane component comprising more than 3 weight % of the copolymer and the polysiloxane component having a molecular weight of at least about 1500.

20 Claims, No Drawings

SLIPPING LAYER FOR DYE-DONOR ELEMENT USED IN THERMAL DYE TRANSFER

This invention relates to dye donor elements used in thermal dye transfer, and more particularly to the use of certain siloxane copolymers on the back side thereof to prevent various printing defects and tearing of the donor element during the printing operation.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method for Controlling A Thermal Printer Apparatus," issued Nov. 4, 1986, the disclosure of which is hereby incorporated by reference.

A problem has existed with the use of dye-donor elements for thermal dye-transfer printing because a thin support is required in order to provide effective heat transfer. For example, when a thin polyester film is employed, it softens when heated during the printing operation and then sticks to the thermal printing head, preventing donor transport. A slipping layer is typically provided to facilitate passage of the dye-donor under the thermal printing head. A defect in the performance of that layer causes intermittent rather than continuous transport across the thermal head. The dye transferred thus does not appear as a uniform area, but rather as a series of alternating light and dark bands (chatter marks).

U.S. Pat. Nos. 4,910,087 and 4,942,212 disclose a heat-resistant layer on the back surface of a thermal dye-donor element comprising a polyurethane or polyurea resin modified with polysiloxane blocks. There are a number of problems with this slipping layer including sticking between the dye layer and slipping layer when the donor is rolled up, dye crystallization caused by contact of the dye layer with the slipping layer, and head debris built-up upon processing. It is an object of this invention to eliminate or reduce the above problems.

JP 02/228,323 relates to the use of a slipping layer of a polyester made from a low molecular weight poly(-dimethylsiloxane) and ε-caprolactone. There is a problem with these materials, however, in that severe crystallization is obtained upon keeping at elevated temperatures in a roll, as will be shown by comparative tests hereafter.

U.S. Pat. No. 4,961,997 discloses the use of polysiloxane/urethane copolymers in a slipping layer for a wax transfer donor. Such polymers also contain a polyester moiety in the diol component of the polyurethane. However, these polymers do not have an amide linkage and also contain a heat resistant organic powder and a crosslinking agent. Use of a binder capable of reacting with the crosslinking agent was also disclosed. There is a problem with using this type of slipping layer in that heat is required to effect a cure. For example with polyisocyanates, a curing temperature of 55°-60° C. might be needed for 24-48 hours after coating on thin polyester support. Curing of a coated roll with dye in contact with the slipping could lead to excessive transfer of dye to the slipping layer.

It is an object of this invention to provide a siloxane polymer which would not need curing in order to avoid the problems and cost associated with curing. It is another object of this invention to provide a single polysiloxane polymer for use as a slipping layer which would have minimal unreacted siloxane monomer units and be coatable from a solvent which is completely removed at drying temperatures, thus avoiding crystallization of the image dyes on keeping at elevated temperatures and sticking or blocking in a roll.

These and other objects are achieved in accordance with this invention which relates to a dye-donor element for thermal dye transfer comprising a support having on one side thereof a dye layer and on the other side a slipping layer comprising a lubricating material and wherein the lubricating material consists essentially of a poly(aryl ester, aryl amide)-siloxane copolymer, the polysiloxane component comprising more than 3 weight % of the copolymer and the polysiloxane component having a molecular weight of at least about 1500.

The above copolymers can be synthesized in solvents appropriate for isolation and purification. Removal of liquid siloxane starting materials and avoidance of solvents, such as dimethylformamide, make it possible to eliminate dye crystallization. These polymers also have the appropriate physical properties to provide good lubrication across the range of the printing temperatures, thereby allowing good transport through a thermal printer, and can function as the only component of a slipping layer without the need to add solid particles, liquid additives, or to crosslink the polymer with its attendant disadvantages. The block copolymers of the invention exhibit good thermal properties since they contain aryl moieties, a structural feature providing direct adhesion to the support, without the need for a separate subbing layer.

In a preferred embodiment of the invention, the poly(aryl ester, aryl amide)-siloxane copolymer contains recurring units having the structural formula:

$$\left[A\left(B\right)\right]\left[C\right]$$

wherein A represents carbonic acid or an aromatic or aliphatic dicarboxylic acid such as terephthalic acid, isophthalic acid, azeleic acid, 1,1,3-trimethyl-3-(4'-carboxy-phenyl)-5-carboxyindane, etc.;

B represents an aromatic diol such as 4,4'-(hexahydro-4,7-methanoindene-5-ylidene)diphenol, 4,4'dihydroxy-diphenylsulfone, 4,4'-(hexafluoroisopropylindene)diphenol, or bisphenol-A having the formula

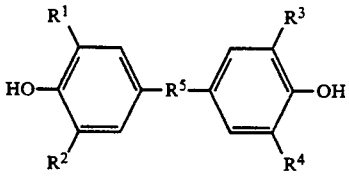

wherein $R^1$, $R^2$, $R^3$, $R^4$ each individually represents H or an alkyl group containing from 1 to 4 carbon atoms, Cl or Br; and $R^5$ represents 4,7-methanoindene-5-ylidene, diphenylsulfone, isopropylidene or hexafluoroisopropylidene; and C represents a group having the structural formula:

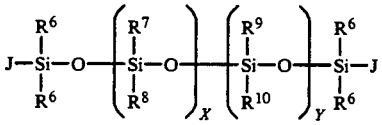

wherein: each J independently represents a direct bond; an alkyl, fluoroalkyl or alkoxy group having from 1 to about 5 carbon atoms; an aryl group having from 6 to about 12 carbon atoms; aminopropyl; or carboxylate;

$R^6$, $R^7$, $R^8$, $R^9$, and $R^{10}$ each independently represents aryl, alkyl or fluoroalkyl, as described above for J; and the values of X and Y are each from 0 to about 400, such that the value of X+Y is from 50 to about 400.

The polysiloxane content can be varied optimally over a range of 3 to 40 weight %. The overall molecular weight, in general, is from 40,000 to 250,000. The glass transition temperatures of the polymers usually exceeded 70° C. In the examples hereinafter, the copolymers were synthesized to produce a random block copolymer. However, such materials can be made so that the polysiloxane block is attached to the polyester as an end group.

The poly(dimethylsiloxanes) which can be employed in the invention are available commercially such as SWS F881-A, mol. wt. 1700; SWS F881-B, mol. wt. 3900 and SWS F881-C, mol. wt. 7400; (Waker Silicones Co.); PS-510, mol. wt. 2500; and PS-513, mol. wt. 27,000; (Huls America Co.); and X2-2616, mol. wt. 14,000 (Dow Corning).

The siloxane copolymer defined above can be employed in the invention herein at any concentration useful for the intended purpose. In general, good results have been obtained at a concentration of about 0.05 to about 1.0 g/m$^2$, preferably about 0.3 to about 0.6 g/m$^2$.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS ® (Sumitomo Chemical Co., Ltd.), Dianix Fast Violet 3R FS ® (Mitsubishi Chemical Industries, Ltd.), and Kayalon Polyol Brilliant Blue N BGM ® and KST Black 146 ® (Nippon Kayaku Co., Ltd.); azo dyes such as Kayalon Polyol Brilliant Blue BM ®, Kayalon Polyol Dark Blue 2BM ®, and KST Black KR ® (Nippon Kayaku Co., Ltd.), Sumickaron Diazo Black 5G ® (Sumitomo Chemical Co., Ltd.), and Miktazol Black 5GH ® (Mitsui Toatsu Chemicals, Inc.); direct dyes such as Direct Dark Green B ® (Mitsubishi Chemical Industries, Ltd.) and Direct Brown M ® and Direct Fast Black D ® (Nippon Kayaku Co. Ltd.); acid dyes such as Kayanol Milling Cyanine 5R ® (Nippon Kayaku Co. Ltd.); basic dyes such as Sumicacryl Blue 6G ® (Sumitomo Chemical Co., Ltd.), and Aizen Malachite Green ® (Hodogaya Chemical Co., Ltd.);

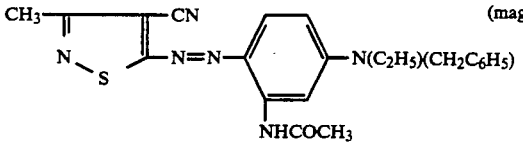

(magenta)

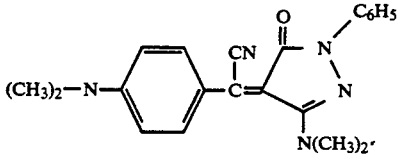

(magenta)

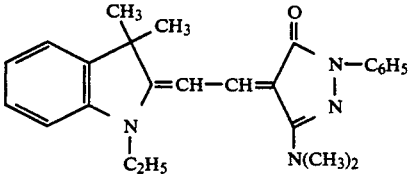

(yellow)

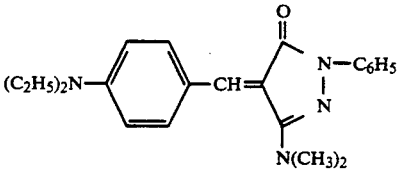

(yellow)

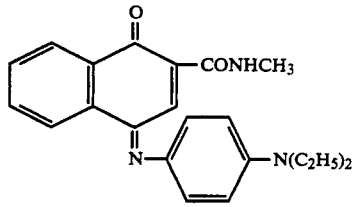

(cyan)

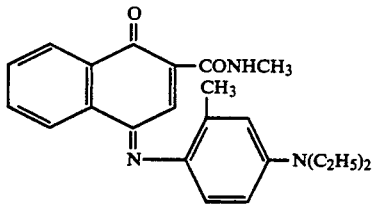

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144 by Vanier, Lum and Bowman.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide amides and polyetherimides. The support generally has a thickness of from about 2 to about 30 μm. It may also be coated with a subbing layer, if desired, such as those materials described in U.S. Pat. No. 4,695,288 or U.S. Pat. No. 4,737,486.

The dye-receiving element that is used with the dye-donor element of the invention usually comprises a support having thereon a dye image receiving layer. The support may be a transparent film such as a poly(ether sulfone), a polyimide, a cellulose ester such as cellulose acetate, a poly(vinyl alcoholco-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as DuPont Tyvek ®.

The dye image-receiving layer may comprise, for example, a polycarbonate, a polyurethane, a polyester, poly(vinyl chloride), poly(styrene-coacrylonitrile), polycaprolactone or mixtures thereof. The dye image-receiving layer may be present in any amount which is effective for the intended purpose. In general, good results have been obtained at a concentration of from about 1 to about 5 g/m$^2$.

As noted above, the dye donor elements of the invention are used to form a dye transfer image. Such a process comprises imagewise heating a dye-donor element as described above and transferring a dye image to a dye receiving element to form the dye transfer image.

The dye donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651; 4,695,287; 4,701,439; 4,757,046; 4,743,582; 4,769,360 and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCSOO1), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye receiving element being in a superposed relationship with the dye donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process is repeated. The third color is obtained in the same manner.

The following examples are provided to illustrate the invention.

POLYMER 1—PREPARATION OF POLYESTER/POLY(DIMETHYLSILOXANE) COPOLYMERS

Bisphenol-A, 22.83g (0.10 mole), poly(dimethylsiloxane), PDMS, of approx. Mw 14,000 29.4g (0.0021 mole), dichloromethane 100 mL and triethylamine 22.26g (0.22 mole) were charged to a reaction vessel equipped with overhead stirring, nitrogen gas inlet, condenser, and an addition funnel. The vessel was cooled to 0° C. and a solution of isophthaloyl chloride 10.15g (0.05 mole), azelaoyl chloride 11.26g (0.05 mole) and dichloromethane 75 mL was added dropwise to the stirred reaction mixture. Then the polymer molecular weight was maximized by adding (0.0025 mole) portions of the acid chlorides mixed with 5 mL dichloromethane. After stirring for 3 hours at room temperature, the reaction mixture was washed with dilute hydrochloric acid solution, 2% (400 mL), followed by water washings (3×400 mL). The polymer was then precipitated into methanol, filtered and dried in a vacuum oven at 40° C. for 24 hours. The product was taken up in dichloromethane to form a 10% solution, placed in a separatory funnel and let stand for 24 hours. The resultant 2 phases were separated and the lower phase polymer Mw=100,000; Mn=22,500, Tg=102° C. was coated without isolation. This polymer is designated below as P-1.

POLYMERS 2-13—PREPARATION OF POLYESTER/POLY(DIMETHYLSILOXANE) COPOLYMERS

The synthesis of polymers 2-13 followed the same general procedure as described above for Polymer 1 except that no separation of phases was undertaken.

TABLE 1

| POLYESTER/POLY(DIMETHYLSILOXANES) | | | | |
|---|---|---|---|---|
| | ESTER COMPONENTS | | PDMS | |
| POLYMER | ACID(S)* (Ratio) | DIOL** | Wt % | M.W. |
| P-1 | A-1, A-2 (1/1) | D-1 | 40 | 14000 |

TABLE 1-continued

| POLYESTER/POLY(DIMETHYLSILOXANES) | | | | |
|---|---|---|---|---|
| | ESTER COMPONENTS | | PDMS | |
| POLYMER | ACID(S)* (Ratio) | DIOL** | Wt % | M.W. |
| P-2 | A-1, A-2 (1/1) | D-1 | 40 | 2500 |
| P-3 | A-1, A-2 (1/1) | D-1 | 40 | 27000 |
| P-4 | A-1, A-2 (1/1) | D-1 | 10 | 14000 |
| P-5 | A-1, A-3 (1/1) | D-1 | 40 | 14000 |
| P-6 | A-3 | D-2 | 40 | 14000 |
| P-7 | A-2, A-3 (1/1) | D-1 | 40 | 2500 |
| P-8 | A-5 | D-1 | 40 | 14000 |
| P-9 | A-4 | D-1 | 40 | 1700 |
| P-10 | A-1 | D-1 | 40 | 14000 |
| P-11 | A-1, A-2 (1/1) | D-3 | 40 | 14000 |
| P-12 | A-1, A-2 (1/1) | D-4 | 40 | 14000 |
| P-13 | A-3 | D-2 | 20 | 14000 |

*ACIDS
A-1: azelaic acid
A-2: isophthalic acid
A-3: terephthalic acid
A-4: carbonic acid
A-5: 1,1,3-trimethyl-3-(4'-carboxyphenyl)-5-carboxyindane
**DIOLS
D-1: Bisphenol-A
D-2: 4,4'-(hexahydro-4,7-methanoindene-5-ylidene)-diphenol
D-3: 4,4'-dihydroxy-diphenylsulfone
D-4: 4,4'-(hexafluoroisopropylidene)diphenol

PREPARATION OF COMPARATIVE PRIOR ART POLYMERS COMPARATIVE POLYMER CP-1

Synthesis of a polyurea resin containing poly(dimethylsiloxane) blocks (Example 2 in U.S. Pat. No. 4,910,087).

Into a reaction vessel equipped with overhead stirring, nitrogen inlet, and a condenser were placed 102 g (0.12 eq.) of Wacker Silicones product SWS F881-A, Mw 1700, 100 g (dry) dimethylformamide, 150 g (dry) methyl ethyl ketone and 3 drops of dibutyltin dilaurate. The temperature of the reaction mixture was reduced to 15° C. and a solution of 15.7 g (0.12 eq) HMDI (Desmodur W, a 1,1-methylenebis-[4-isocyanatocyclohexane], available from Mobay Corp.) and 50 g (dry) methyl ethyl ketone was added dropwise with stirring over 30 minutes. When the addition was complete the temperature of the reaction mixture was increased to 60° C. and stirring was continued for 12 hours. The progress of the reaction was followed by monitoring the disappearance of the IR absorption band due to NCO. When the reaction was complete the mixture was cooled to room temperature filtered and bottled. The resultant poly(dimethyl-siloxane)/polyurea had a Mw=72,600; Mn=12,100 and a Tg=40.1° C. Tm=133.4° C.

COMPARATIVE POLYMER CP-2: POLY(BISPHENOL A-CO-ISOPHTHALATE-CO-AZELATE)

To a flask equipped with a mechanical stirrer, addition funnel, nitrogen gas inlet and a condenser was added 22.83 g (0.10 mole) of bisphenol A, 22.26 g (0.22 mole) triethylamine and 100 mL of dichloromethane. The solution was cooled to 0 °-5° C. with an ice bath, and a solution of 10.15 g (0.05 mole) isophthaloyl chloride, 11.25 g (0.05 mole) azelaoyl chloride, and 70 mL of dichloromethane was slowly added with stirring. The molecular weight of the polymer was optimized with the addition of 0.0025 mole portions of the acid chlorides dissolved in dichloromethane. The mixture was stirred for 3 hours at room temperature and the product was washed with 2% HCl/water followed by 2 distilled water washes. The product was precipitated into methanol, collected, and dried at 40° C. for 24 hours in a vacuum oven. The polymer had a Mw=89,000, and a Mn=18,900.

COMPARATIVE POLYMER CP-3: POLYESTER/POLYSILOXANE COPOLYMER (FROM EXAMPLE 1 JP 02/228323)

Example 1—Crystal Formation Test

A magenta dye-donor was prepared by coating on a 6 μm poly(ethylene terephthalate) support:

(1) a subbing layer of titanium alkoxide (DuPont Tyzor TBT)® (0.13 g/m²) from n-propyl acetate and n-butyl alcohol mixture, and (2) a dye layer containing the first magenta dye illustrated above (0.22 g/m²) and Shamrock S363 N-1 polypropylene wax micronized powder (Shamrock Chemicals Corporation) (0.021 g/m²) in a cellulose acetate propionate (2.5% acetyl, 45% propionyl) binder (0.47 g/m²) coated from a toluene, methanol, cyclopentanone solvent mixture.

On the backside of the dye-donor was coated a slipping layer consisting of polymer P-1 (0.54 g/m²) coated from dichloromethane.

The coated dye-donor was wrapped on itself on a polypropylene spindle 1.9 cm in diameter. The dye-donor was then sealed in a foil-lined paper bag kept at 22° C. and at about 45% relative humidity. The bag was then heated to 60° C. and kept for 3 days. After this period, the dye side of the dye-donor was examined under a microscope at 155× magnification for formation of crystals of magenta dye during the 60° C. storage. The coatings were also examined for sticking of the dye side to the slipping layer after heating. The results are shown in Table 2.

CONTROL 1

Comparative Polymer CP-1 was coated on the backside of the dye-donor as described above. The polymer solution in dimethylformamide and methyl ethyl ketone from CP-1 was diluted with methyl ethyl ketone and coated at 0.54 g/m². Control 1 represents prior art in which a polyurea/siloxane polymer, made without purification from starting materials and high boiling solvents, was used as a slipping layer. It was tested as above and the results are shown in Table 2.

CONTROL 2

On the backside of the magenta dye donor as described above was coated a slipping layer containing the aminopropyl-terminated poly(dimethylsiloxane) PS-513 (0.011 g/m²) (Huls America), p-toluenesulfonic acid (0.003 g/m²) and bleached German Montan wax (0.032 g/m²) (Frank B. Ross Co) in a cellulose acetate propionate binder (2.5% acetyl, 45% propionyl) (0.54 g/m²) coated from a solvent mixture of toluene, methanol and cyclopentanone. Control 2 represents prior art using a liquid poly(dimethylsiloxane) as part of the lubricant in a binder. It was tested as above and the results are shown in Table 2.

TABLE 2

| Sticking and Dye Crystallization | | |
|---|---|---|
| SLIPPING LAYER | DYE CRYSTAL FORMATION | STICKING OF DYE TO BACK |
| P-1 | None | No |
| Control 1 | Severe | Yes |

TABLE 2-continued

| SLIPPING LAYER | Sticking and Dye Crystallization: DYE CRYSTAL FORMATION | STICKING OF DYE TO BACK |
|---|---|---|
| Control 2 | Severe | No |

The above data show that the invention slipping layer formed no crystals on heating while both controls showed formation of many dye crystals in the donor. Control 1 also showed an objectionable level of sticking of the dye side to the back side after heating.

EXAMPLE 2—Force Measurement Test

The dye-donors of Example 1 were used in this test.

A dye-receiving element was prepared by coating the following layers in the order recited on a titanium oxide-pigmented polyethylene-overcoated paper stock which was subbed with a layer of copoly(acrylonitrile/-vinylidene chloride/acrylic acid) (14:79:7 wt ratio) (0.08 g/m$^2$) coated from 2-butanone:

1) dye-receiving layer of Makrolon 5700® (Bayer AG Corporation) polycarbonate resin (2.9 g/m$^2$), Tone PCL-300® polycaprolactone (Union Carbide Corp.) (0.38 g/m), and 1,4-didecoxy-2,5-dimethoxybenzene (0.38 g/m$^2$) coated from methylene chloride; and 2) overcoat layer of Tone PCL-300® polycaprolactone (Union Carbide Corp.) (0.11 g/m$^2$), FC-431 surfactant (3M Company) (0.011 g/m$^2$) and DC-510 surfactant (Dow Corning Company) (0.011 g/m$^2$) coated from methylene chloride.

The dye side of the dye-donor elements described above, in a strip about 10×13 cm in area, was placed in contact with the dye image-receiving layer of a dye-receiver element, as described above, of the same area. The assemblage was clamped to a stepper-motor driving a 60 mm diameter rubber roller, and a TDK Thermal Head (No. L-231) (thermostatted at 24.5° C.) was pressed with a force of 36 Newtons against the dye-donor element side of the assemblage pushing it against the rubber roller.

The imaging electronics were activated causing the donor/receiver assemblage to be drawn between the printing head and the roller at 6.9 mm/sec. Coincidentally, the resistive elements in the thermal print head were pulsed for 29 microseconds/pulse at 128 microsecond intervals during the 33 millisecond/dot printing time. A stepped density image was generated by incrementally increasing the number of pulse/dot from 0 to 255. The voltage supplied to the print head was approximately 24.5 volts resulting in an instantaneous peak power of 1.24 watts/dot and a maximum total energy of 9.2 mjoules/dot. As each "area test pattern" of a given density was being generated, the force required for the pulling device to draw the assemblage between the print head and roller was measured using a Himmelstein Corp. 3-08TL(16-1) Torquemeter (1.13 meter-Newton range) and a 6-201 Conditioning Module. Data were obtained at steps 0, 2 and 8, minimum, moderate and maximum densities, respectively. The following results were obtained:

TABLE 3

| SLIPPING LAYER | Relative Force (NEWTONS): STEP 0 | STEP 2 | STEP 8 |
|---|---|---|---|
| P-1 | 3.4 | 5.4 | 6.7 |
| Control 1 | 10.1 | 6.6 | 4.6 |

TABLE 3-continued

| SLIPPING LAYER | Relative Force (NEWTONS): STEP 0 | STEP 2 | STEP 8 |
|---|---|---|---|
| Control 2 | 3.5 | 4.0 | 3.8 |

The data show that P-1 compared well with Control 2, a slipping layer with good frictional behavior at all printed densities. P-1 resulted in lower forces compared to Control 1 at step 0 and step 2, and it also had a more uniform friction force vs. temperature profile, i.e., the friction force varied less with temperature as compared to Control 1.

EXAMPLE 3—Head Debris Test

The debris deposited on a thermal printing head (TDK Thermal Head L-231) was studied by use of a modified Kodak SV 6500 Color Video Printer. The printer was programmed to print in a continuous mode. By means of a Kodak SV60 Bidirectional Interface Card and the SV 6500 Video Printer Utility Software, the printer was programmed to print maximum density with the minimum head temperature set at 40° C. Ninety transfer prints were made successively from each tested dye-donor to a receiver (described in Example 2). Each dye-donor was printed three times to the dye-receiving element at maximum density (2.6 Status A green reflection density) to produce each print. This amounted to 270 passes of the dye-donor past the printing head for each dye-donor. The heating line of the printing head was examined by reflection microscopy at 78× magnification before and after use.

Photomicrographs were made with a Sony DX 3000 Video Camera and a Kodak SV 6500 Color Video Printer attached to an Olympus BH2 microscope. The dye-donors tested and the debris left on the heating line of the thermal printing head are described in Table 4. The number of visible scratches in each print were counted and expressed as an average number per set of ten prints for each dye donor tested.

TABLE 4

| SLIPPING LAYER | Head Debris Test: AMOUNT OF HEAD DEBRIS | AVERAGE NUMBER OF SCRATCHES IN PRINT |
|---|---|---|
| P-1 | Light | 0.1 |
| Control 1 | Very Heavy | 40 |
| Control 2 | Heavy | 0 |

The above data show the superiority of the invention P-1 over Control 1 and Control 2 for production of minimal head debris. P-1 also was clearly superior to Control 1 (a polyurea/polysiloxane copolymer) for freedom from print scratches.

EXAMPLE 4—Force Measurement Test

A multicolor dye-donor was prepared by gravure coating on a 6 μm poly(ethylene terephthalate)

1) a subbing layer of titanium alkoxide (DuPont Tyzor TBT)® (0.13 g/m$^2$) from a n-propyl acetate and n-butyl alcohol solvent mixture, and 2) a dye layer containing the first cyan dye illustrated above (0.42 g/m$^2$) and Fluo HT® micronized poly(tetrafluoroethylene) (Micro Powders Inc.) (0.048 g/m$^2$), in a cellulose acetate propionate (2.5% acetyl, 45% propionyl) (0.66 g/m$^2$) coated from a toluene, methanol and cyclopentanone solvent mixture.

In a similar manner, repeating, alternating areas of the first yellow dye illustrated above (0.20 g/m$^2$) and the first magenta dye 0.22 g/m$^2$) illustrated above were coated.

On the backside of the dye-donor was coated:

1) a slipping layer composed of the invention or control polymers (0.27 g/m$^2$) listed below coated from solution as described above for Example 1. Control 3 was coated from CP-2 in the same way as for the invention polymers. Control 4 was made with a slipping layer and subbing layer like those described above for Control 2. See Table 1 for details of composition of invention polymers.

The dye-receiving elements of Example 2 were used with the above dye-donors and tested as in Example 2. The following results were obtained:

TABLE 5

| SLIPPING LAYER | Friction Force Profile Relative Force (Newtons) STEP 0 | STEP 2 | STEP 8 |
|---|---|---|---|
| Control 3 | 24.9 | 21.3 | 17.8 |
| P-1 | 3.4 | 5.4 | 6.7 |
| P-2 | 4.2 | 7.5 | 6.2 |
| P-3 | 3.9 | 4.9 | 7.1 |
| P-4 | 4.4 | 5.8 | 6.7 |
| P-5 | 4.1 | 6.2 | 7.1 |
| P-6 | 4.2 | 5.8 | 7.5 |
| P-7 | 4.0 | 4.4 | 5.8 |
| P-8 | 4.2 | 5.8 | 7.5 |
| P-9 | 5.3 | 7.5 | 7.1 |
| P-10 | 5.8 | 7.5 | 8.9 |
| P-11 | 5.8 | 7.1 | 8.4 |
| P-12 | 6.7 | 7.5 | 9.3 |
| P-13 | 4.1 | 4.9 | 6.7 |
| Control 4 | 4.0 | 5.8 | 5.3 |

The above data show the beneficial effect on friction during printing by the introduction of poly(dimethylsiloxane) blocks into an aryl polyester. Control 3 is a polyester without polysiloxane blocks. The data also show that the polysiloxane blocks can be varied in molecular weight and in amount in the copolymer. Examples of variations possible in the polyester component are also illustrated. It is seen that the invention copolymer coated as the only component of the slip layer can approach the friction of a wax-liquid silicone system, such as Control 4.

EXAMPLE 5—Sticking and Dye Crystallization

A multicolor dye-donor was coated as in Example 4 above with a Tyzor® subbing layer and a cyan dye layer containing the first and second cyan dyes (0.41 g/m$^2$) (1.40 g/m$^2$) illustrated above, the fluorocarbon surfactant FC-430 (0.002 g/m$^2$) (3M Corp.) and S363 N-1 polypropylene wax micronized powder (0.021 g/m$^2$) (Shamrock Chemicals Co.) in a cellulose acetate propionate (2.5% acetyl, 45% propionyl) binder (0.36 g/m$^2$) coated from a toluene, methanol and cyclopentanone mixture. In a similar manner, repeating, alternating areas of the first yellow dye illustrated above (0.26 g/m$^2$) and the two magenta dyes (0.17 g/m$^2$) (0.26 g/m$^2$) illustrated above were coated.

On the backside of the dye-donor was coated P-13 (0.54 g/m$^2$) as in Example 1. For comparison the siloxane polyester described in CP-3 (Ex. 1 JP 02/228323) (0.58 g/m$^2$) was coated in a similar manner from 2-butanone. CP-3 is a polyester made by copolymerizing a lactone with siloxane bearing amino groups. In addition, a slipping layer was coated with CP-3 (0.54 g/m$^2$) along with the polyisocyanate Mondur® CB-75 (2.35 g/m$^2$) or 4.7 g/m$^2$) (Mobay Chemical Corporation) and the catalyst ferric acetylacetonate (0.0054 g/m$^2$).

The coatings were wound on a wooden dowel (22 mm diameter) and incubated in an oven at 50° C. and 50% relative humidity for 2 weeks. The coatings were then unwound and evaluated for sticking of the slipping layer to the dye side and for crystallization of the dyes. The following results were obtained:

TABLE 6

| SLIPPING LAYER | Sticking and Dye Crystallization STICKING OF DYE TO BACK | DYE CRYSTAL FORMATION |
|---|---|---|
| P-13 | None | None |
| CP-3 | Yes | Severe, all dyes |
| CP-3 + 2.35 g/m$^2$ Mondur CB-75 | Yes | Severe, all dyes |
| CP-3 + 4.7 g/m$^2$ Mondur CB-75 | Yes | Severe, all dyes |

The above data show that the invention polymer was superior to CP-3, coated alone or with an isocyanate crosslinking agent, in resistance to sticking to the dye side or inducing crystallization of the dyes on storage at 50° C.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a support having on one side thereof a dye layer and on the other side a slipping layer comprising a lubricating material, the improvement wherein said lubricating material consists essentially of a poly(aryl ester, aryl amide)-siloxane copolymer, the polysiloxane component comprising more than 3 weight % of the copolymer and the polysiloxane component having a molecular weight of at least about 1500.

2. The element of claim 1 wherein said poly(aryl ester, aryl amide)-siloxane copolymer is derived from carbonic acid or an aromatic or aliphatic dicarboxylic acid; a bisphenol; and a diaminosiloxane.

3. The element of claim 1 wherein said poly(aryl ester, aryl amide)-siloxane copolymer contains recurring units having the structural formula:

$$\left[A\left(B\right)\right]\left[C\right]$$

wherein A represents carbonic acid or an aromatic or aliphatic dicarboxylic acid;

B represents an aromatic diol; and

C represents a group having the structural formula:

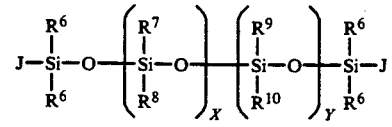

wherein: each J independently represents a direct bond; an alkyl, fluoroalkyl or alkoxy group having from 1 to about 5 carbon atoms; an aryl group having from 6 to about 12 carbon atoms; aminopropyl; or carboxylate;

$R^6$, $R^7$, $R^8$, $R^9$, and $R^{10}$ each independently represents aryl having from 6 to about 12 carbon atoms, alkyl or fluoroalkyl having from 1 to about 5 carbon atoms; and the values of X and Y are each from 0 to about 400, such that the value of X+Y is from 50 to about 400.

4. The element of claim 3 wherein J is $-(CH_2)_3-$ or $-(CH_2)_4-$.

5. The element of claim 3 wherein J is a direct bond.

6. The element of claim 3 wherein A represents carbonic acid, terephthalic acid, isophthalic acid, azeleic acid, or 1,1,3-trimethyl-3-(4'-carboxy-phenyl)-5-carboxyindane.

7. The element of claim 3 wherein B represents

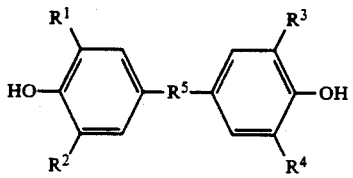

wherein:

$R^1$, $R^2$, $R^3$, $R^4$ each individually represents H, an alkyl group containing from 1 to 4 carbon atoms, Cl or Br; and $R^5$ represents 4,7-methanoindene-5-ylidene, diphenylsulfone, isopropylidene or hexafluoroisopropylidene.

8. In a process of forming a dye transfer image comprising (a) imagewise-heating a dye-donor element comprising a support having on one side thereof a dye layer and on the other side a slipping layer comprising a lubricating material, and (b) transferring a dye image to a dye receiving element to form said dye transfer image, the improvement wherein said lubricating material consists essentially of a poly(aryl ester, aryl amide)-siloxane copolymer, the polysiloxane component comprising more than 3 weight % of the copolymer and the polysiloxane component having a molecular weight of at least about 1500.

9. The process of claim 8 wherein said poly(aryl ester, aryl amide)-siloxane copolymer is derived from carbonic acid or an aromatic or aliphatic dicarboxylic acid; a bisphenol; and a diaminosiloxane.

10. The process of claim 8 wherein said poly(aryl ester, aryl amide)-siloxane copolymer contains recurring units having the structural formula:

$$\left[A\left[B\right]\right]\left[C\right]$$

wherein A represents carbonic acid or an aromatic or aliphatic dicarboxylic acid;

B represents an aromatic diol; and

C represents a group having the structural formula:

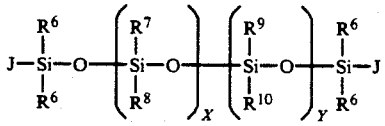

wherein: each J independently represents a direct bond; an alkyl, fluoroalkyl or alkoxy group having from 1 to about 5 carbon atoms; an aryl group having from to about 12 carbon atoms; aminopropyl; or carboxylate;

$R^6$, $R^7$, $R^8$, $R^9$, and $R^{10}$ each independently represents aryl, having from 6 to about 12 carbon atoms, alkyl or fluoroalkyl having from 1 to about 5 carbon atoms; and the values of X and Y are each from 0 to about 400, such that the value of X+Y is from 50 to about 400.

11. The process of claim 10 wherein J is $-(CH_2)_3-$ or $-(CH_2)_4-$.

12. The process of claim 10 wherein J is a direct bond.

13. The process of claim 10 wherein A represents carbonic acid, terephthalic acid, isophthalic acid, azeleic acid, or 1,1,3-trimethyl-3(4'-carboxy-phenyl)-5-carboxyindane.

14. The process of claim 10 wherein B represents

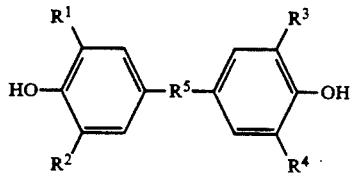

wherein:

$R^1$, $R^2$, $R^3$, $R^4$ each individually represents H, an alkyl group containing from 1 to 4 carbon atoms, Cl or Br; and $R^5$ represents 4,7-methanoindene-5-ylidene, diphenylsulfone, isopropylidene or hexafluoroisopropylidene.

15. In a thermal dye transfer assemblage comprising (a) a dye-donor element comprising a support having on one side thereof a dye layer and on the other side a slipping layer comprising lubricating material, and (b) a dye receiving element comprising a support having thereon a dye image-receiving layer, said dye-receiving element being in a superposed relationship with said dye-donor element so that said dye layer is in contact with said dye image-receiving layer, the improvement wherein said lubricating material consists essentially of a poly(aryl ester, aryl amide)-siloxane copolymer, the polysiloxane component comprising more than 3 weight % of the copolymer and the polysiloxane component having a molecular weight of at least about 1500.

16. The assemblage of claim 15 wherein said poly(aryl ester, aryl amide)-siloxane copolymer is derived from carbonic acid or an aromatic or aliphatic dicarboxylic acid; a bisphenol; and a diaminosiloxane.

17. The assemblage of claim 15 wherein said poly(aryl ester, aryl amide)-siloxane copolymer contains recurring units having the structural formula:

$$\left[A\left[B\right]\right]\left[C\right]$$

wherein A represents carbonic acid or an aromatic or aliphatic dicarboxylic acid;

B represents an aromatic diol; and

C represents a group having the structural formula:

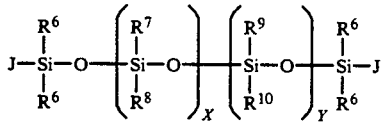

wherein each J independently represents a direct bond; an alkyl, fluoroalkyl or alkoxy group having from 1 to about 5 carbon atoms; an aryl group having from to about 12 carbon atoms; aminopropyl; or carboxylate;

$R^6$, $R^7$, $R^8$, $R^9$, and $R^{10}$ each independently represents aryl having from 6 to about 12 carbon atoms, alkyl or fluoroalkyl having from 1 to about 5 carbon atoms; and the values of X and Y are each from 0 to about 400, such that the value of X+Y is from 50 to about 400.

18. The assemblage of claim 17 wherein J is $-(CH_2)_3-$, $-(CH_2)_4-$, or a direct bond.

19. The assemblage of claim 17 wherein A represents carbonic acid, terephthalic acid, isophthalic acid, azeleic acid, or 1,1,3-trimethyl-3-(4'-carboxy-phenyl)-5-carboxyindane.

20. The assemblage of claim 17 wherein B represents

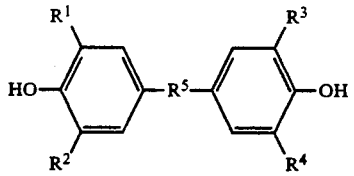

wherein:

$R^1$, $R^2$, $R^3$, $R^4$ each individually represents H, an alkyl group containing from 1 to 4 carbon atoms, Cl or Br; and $R^5$ represents 4,7-methanoindene-5-ylidene, diphenylsulfone, isopropylidene or hexafluoroisopropylidene.

* * * * *

UNITED STATES PATENT AND TRADEMARK OFFICE

CERTIFICATE OF CORRECTION

PATENT NO.: 5,234,889

DATED: August 10, 1993

INVENTOR(S): Vito A. DePalma, Catherine A. Falkner, Ravi Sharma, Paul D. Yacobucci and David P. Brust

It is certified that error appears in the above-identified patent and that said Letters Patent is hereby corrected as shown below:

Column 14, line 2, "from to" should read ---from 6 to--- and line 5, "aryl," should read ---aryl---.

Column 15, line 12, "from to" should read ---from 6 to---.

Signed and Sealed this

Fifteenth Day of March, 1994

*Attest:*

*Attesting Officer*

BRUCE LEHMAN

*Commissioner of Patents and Trademarks*